US010026320B2

(12) United States Patent
Ryu et al.

(10) Patent No.: US 10,026,320 B2
(45) Date of Patent: Jul. 17, 2018

(54) VEHICLE AND METHOD FOR SUPPORTING DRIVING SAFETY THEREOF

(71) Applicant: Hyundai Motor Company, Seoul (KR)

(72) Inventors: Seong Sook Ryu, Seoul (KR); Byoung Joon Lee, Gyeonggi-do (KR); Jin Kwon Kim, Gyeonggi-do (KR); Ho Choul Jung, Gyeonggi-do (KR); Sam Yong Kim, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 15/340,932

(22) Filed: Nov. 1, 2016

(65) Prior Publication Data

US 2017/0316694 A1 Nov. 2, 2017

(30) Foreign Application Priority Data

May 2, 2016 (KR) ..... 10-2016-0054064

(51) Int. Cl.
*G08G 1/16* (2006.01)

(52) U.S. Cl.
CPC ..... *G08G 1/166* (2013.01)

(58) Field of Classification Search
None
See application file for complete search history.

(56) References Cited

U.S. PATENT DOCUMENTS

2003/0128112 A1* 7/2003 Chow ..... B60Q 1/54 340/466
2003/0167123 A1* 9/2003 Nakazawa ..... G08G 1/166 701/301
2007/0168129 A1* 7/2007 Thorne ..... B60Q 1/525 701/301
2008/0180528 A1 7/2008 Saito
2013/0265414 A1 10/2013 Yoon et al.
2014/0184400 A1* 7/2014 Yang ..... G08G 1/166 340/435
2016/0379350 A1* 12/2016 Matsui ..... B60Q 1/44 348/125
2017/0190286 A1* 7/2017 Yavitz ..... B60Q 1/54
2017/0240109 A1* 8/2017 Kimura ..... B60Q 9/00

FOREIGN PATENT DOCUMENTS

JP 2008-186344 A 8/2008
KR 10-1995-0011228 A 5/1995
KR 10-2003-0001014 A 1/2003
KR 10-2007-0071999 A 7/2007
KR 10-2012-0068292 A 6/2012
KR 10-1324531 B1 11/2013

* cited by examiner

*Primary Examiner* — Laura Nguyen
(74) *Attorney, Agent, or Firm* — Mintz Levin Cohn Ferris Glovsky and Popeo, P.C.; Peter F. Corless

(57) ABSTRACT

A vehicle is provided to detect a failure of rear brake lamps of a preceding vehicle. The vehicle includes a distance detection unit that detects a distance from the vehicle to the preceding vehicle, an image acquisition unit that acquires an image of the preceding vehicle, and a controller that detects the failure of a rear brake lamp of the preceding vehicle occurs using a speed of the preceding vehicle obtained using information of variations in the detected distance and the acquired image of the preceding vehicle. Additionally, the controller generates acceleration and deceleration state information of the preceding vehicle in response to detecting the failure of the rear brake lamp of the preceding vehicle.

7 Claims, 7 Drawing Sheets

VEHICLE AND METHOD FOR SUPPORTING DRIVING SAFETY THEREOF

CROSS-REFERENCE TO RELATED APPLICATION

This application is based on and claims the benefit of priority to Korean Patent Application No. 10-2016-0054064, filed on May 2, 2016, in the Korean Intellectual Property Office, the disclosure of which is incorporated herein in its entirety by reference.

TECHNICAL FIELD

The present disclosure relates to a vehicle and a method for supporting driving safety thereof, and more particularly to a vehicle and a method that detect failure of rear brake lamps of a preceding vehicle to improve driving safety.

BACKGROUND

In general, a vehicle is equipped with brake lamps installed at the rear of the vehicle, providing other vehicles with a notification of when the vehicle is decelerating or stopping to prevent a collision with the rear vehicle. The brake lamps may be turned on when the brake pedal of the vehicle is engaged (e.g., pressure is exerted onto the pedal). The brake lamps are important for driving safety, but it may be difficult for a driver to recognize a failure of the brake lamps, especially while driving. Therefore, when a failure of the lamps is not detected, a driver may continue driving the vehicle, and thus, the braking of the front vehicle may not be recognized, which may cause a traffic accident and the driver of the rear vehicle may have difficult in maintaining a safe distance from the preceding vehicle.

SUMMARY

The present disclosure provides a vehicle configured to detect the failure of rear brake lamps of a preceding vehicle to support a driver's driving safety, and a method for supporting driving safety thereof. The technical problems to be solved by the present inventive concept are not limited to the aforementioned problems, and any other technical problems not mentioned herein will be clearly understood from the following description by those skilled in the art to which the present disclosure pertains.

According to an aspect of the present disclosure, a vehicle may include: a distance detection unit configured to detect a distance from the subject vehicle to a preceding vehicle (e.g., a front vehicle); an image acquisition unit configured to acquire an image of the preceding vehicle; and a controller configured to detect a failure of a rear brake lamp of the preceding vehicle using a speed of the preceding vehicle obtained using information of variations in the detected distance and the acquired image of the preceding vehicle, and generate acceleration and deceleration state information of the preceding vehicle when the failure of the rear brake lamp of the front vehicle is detected.

The controller may further be configured to determine the failure of the rear brake lamp of the preceding vehicle when the speed of the preceding vehicle is reduced and the rear brake lamp of the front vehicle detected from the acquired image is not turned on. The vehicle may further include a friction detection unit configured to detect a friction coefficient of a road on which the subject vehicle is traveling, and the controller may be configured to determine the failure of the rear brake lamp of the preceding vehicle when a reduction in the speed of the preceding vehicle is greater than a reduction in the speed by the friction coefficient of the road.

The vehicle may further include a driver state detection unit configured to acquire an image of a driver and detect a state of the driver, and the controller may be configured to generate the acceleration and deceleration state information when the state of the driver is determined as a careless driving state. The vehicle may further include an output unit configured to output the acceleration and deceleration state information. The output unit may be a head up display (HUD), and the acceleration and deceleration state information may be indicated by detecting an amount of acceleration or deceleration of the front vehicle from the output information. The vehicle may further include a communication unit configured to transmit the acceleration and deceleration state information of the preceding vehicle to another vehicle.

According to another aspect of the present disclosure, a method for supporting driving safety of a vehicle may include: detecting a distance from the subject vehicle to a preceding vehicle; acquiring an image of the preceding vehicle; detecting a failure of a rear brake lamp of the preceding vehicle, using a speed of the preceding vehicle obtained using information of variations in the detected distance and the acquired image of the preceding vehicle; and generating acceleration and deceleration state information of the preceding vehicle when the failure of the rear brake lamp of the front vehicle is detected.

The detection of a failure of a rear brake lamp of the preceding vehicle occurs may include determining the failure of the rear brake lamp of the preceding vehicle when the speed of the front vehicle is reduced and the rear brake lamp of the preceding vehicle detected from the acquired image is not turned on. The method may further include detecting a friction coefficient of a road on which the subject vehicle is traveling, and the detection of a failure of a rear brake lamp of the preceding vehicle occurs may include determining the failure of the rear brake lamp of the preceding vehicle when a reduction in the speed of the preceding vehicle is greater than a reduction in the speed by the friction coefficient of the road. The method may further include acquiring an image of a driver and detecting a state of the driver, and the generating of the acceleration and deceleration state information may include generating the acceleration and deceleration state information when the state of the driver is determined as a careless driving state.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
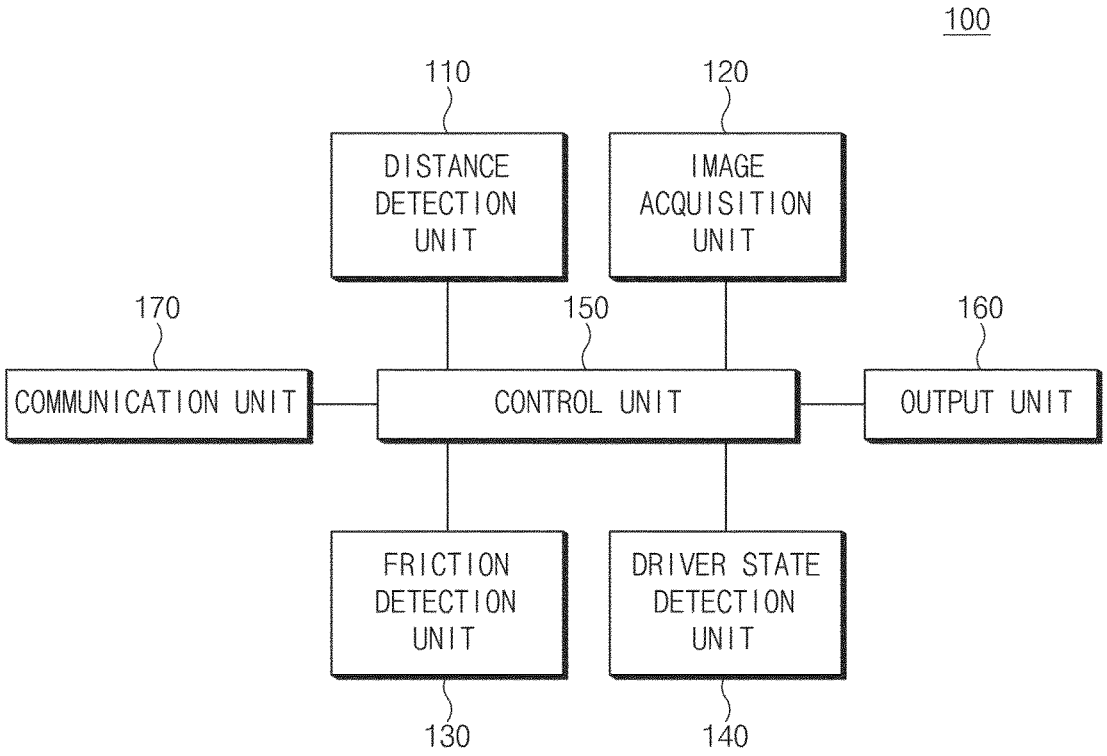
FIG. 1 illustrates a block diagram of a vehicle, according to an exemplary embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

Furthermore, control logic of the present invention may be embodied as non-transitory computer readable media on a computer readable medium containing executable program instructions executed by a processor, controller/control unit or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/of" includes any and all combinations of one or more of the associated listed items.

Hereinafter, exemplary embodiments of the present disclosure will be described in detail with reference to the accompanying drawings. In the drawings, the same reference numbers will be used throughout to designate the same or equivalent elements. In addition, a detailed description of well-known features or functions will be ruled out in order not to unnecessarily obscure the gist of the present disclosure. Unless otherwise defined, all terms used herein, including technical or scientific terms, have the same meanings as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application.

A controller mounted within a vehicle 100, according to an exemplary embodiment of the present disclosure, may be configured to detect a distance from the vehicle 100 to a preceding vehicle traveling in front of the vehicle 100 (e.g., the subject vehicle), acquire an image of the preceding vehicle, detect a failure of a rear brake lamp of the preceding vehicle using a speed of the preceding vehicle obtained using information of variations in the detected distance and the acquired image of the preceding vehicle, generate acceleration and deceleration state information of the preceding vehicle when the failure of the rear brake lamp of the front vehicle is detected, and output the generated acceleration and deceleration state information to allow a driver to recognize the output information, thereby enabling the driver to rapidly respond to the failure when there is a sudden deceleration or the like of the preceding vehicle in response to detecting the failure of the rear brake lamp of the preceding vehicle.

In the present specification, the term "front vehicle" or "preceding vehicle" may be used as a concept including not only a front vehicle within a corresponding lane of the vehicle 100 but also a vehicle traveling in an adjacent lane. In addition, the term "rear brake lamp" may be used as a concept including a tail lamp of a vehicle according to types and designs of the vehicle.

Figure 2A:
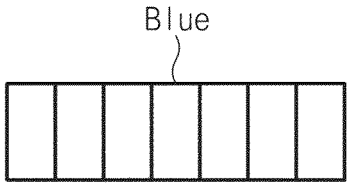
FIGS. 2A and 2B illustrate examples of acceleration and deceleration state information, according to exemplary embodiments of the present disclosure.
Figure 2B:
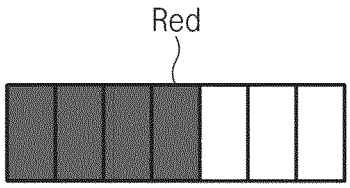
Figure 3:
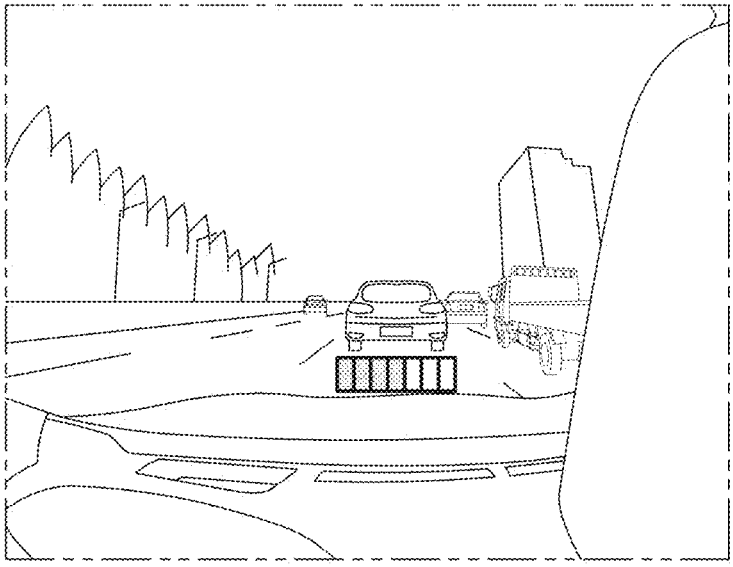
FIGS. 3 and 4 illustrate examples of the output of acceleration and deceleration state information, according to exemplary embodiments of the present disclosure.
Figure 4:
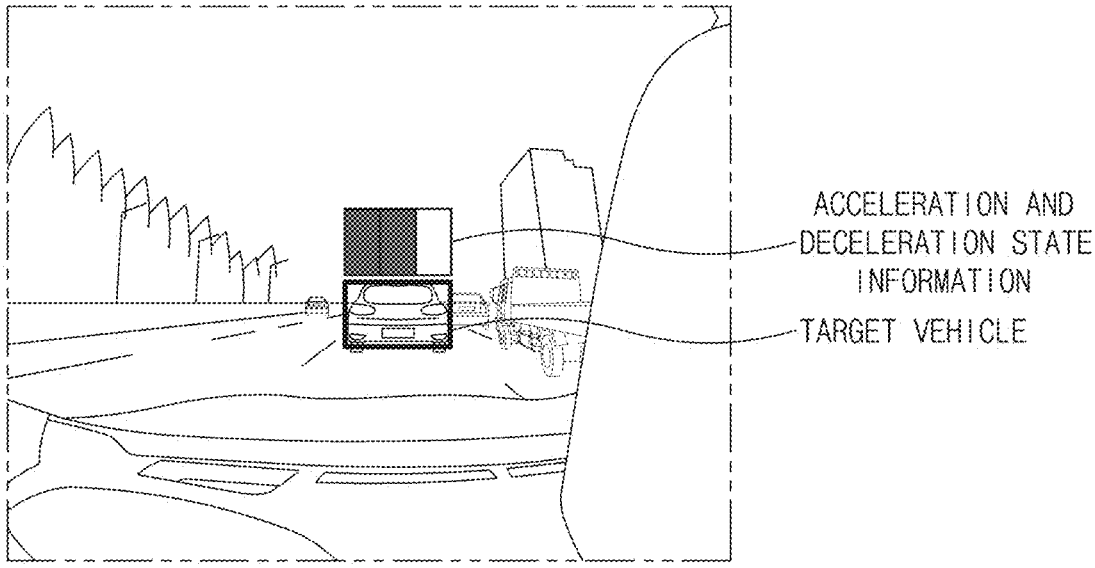

Hereinafter, the functions and operations of respective elements of the vehicle 100, according to an exemplary embodiment of the present disclosure, will be described in more detail. FIG. 1 illustrates a block diagram of a vehicle, according to an exemplary embodiment of the present disclosure. FIGS. 2A and 2B illustrate examples of acceleration and deceleration state information, according to exemplary embodiments of the present disclosure. FIGS. 3 and 4 illustrate examples of the output of acceleration and deceleration state information, according to exemplary embodiments of the present disclosure.

Referring to FIG. 1, the vehicle 100, according to an exemplary embodiment of the present disclosure, may include a distance detection unit 110, an image acquisition unit 120, a friction detection unit 130, a driver state detection unit 140, a controller 150, an output unit 160, and a communication unit 170. The controller 150 may be configured to operate the other units within the vehicle 100. The distance detection unit 110 may be a sensor and may be configured to detect a distance from the subject or traveling vehicle 100 to a preceding vehicle. For example, the distance detection unit 110 may be a radar sensor, a lidar sensor, an ultrasonic sensor, or a laser sensor, but is not limited thereto. The distance detection unit 110 may include various types of sensors configured to measure a distance.

The image acquisition unit 120 may be an imaging device configured to acquire an image of the preceding vehicle. For example, the image acquisition unit 120 may be a lane departure warning (LDW) camera. The image acquisition unit 120 may be disposed in a direction toward the preceding of the vehicle 100, that is, toward a traveling direction of the vehicle). The image acquisition unit 120 may be configured to transmit the image of the preceding vehicle to the controller 150. Further, the friction detection unit 130 may be configured to detect a friction coefficient of a road on which the vehicle 100 is traveling. For example, the friction detection unit 130 may include a wheel speed sensor, a vehicle speed sensor, a yaw rate sensor, a steering angle sensor, a lateral acceleration sensor, and a raindrop sensor, and may be configured to obtain the friction coefficient of the road using information detected or measured by the sensors.

The driver state detection unit 140 may be configured to acquire an image of a driver and detect a state of the driver from the acquired image of the driver. For example, the driver state detection unit 140 may be configured to detect whether the driver is driving carelessly. Particularly, the driver state detection unit 140 may be configured to detect the careless driving state of the driver as whether the driver is driving while drowsy by detecting an area of the eyes of the driver from the driver's image, and whether the driver is looking ahead by detecting a direction of the face of the driver from the driver's image. For example, using the image of the driver, when the eyes are detected to be closed, a careless driving state may be detected. Other known techniques for detecting drowsy driving may also be used. In other words, the driver state detection unit 140 may be configured to detect the attentiveness of the driver. The driver state detection unit 140 may be disposed in a steering wheel of the vehicle 100 to acquire an image of a facial area of the driver.

In addition, the driver state detection unit 140 may be configured to detect the state of the driver from a driving pattern of the vehicle 100. The driving pattern of the vehicle 100 may be obtained from various signals associated with the driving of the vehicle 100. For example, when rapid acceleration or deceleration is continuously detected, careless driving may be determined. The controller 150 may be configured to determine whether a failure of the rear brake lamp of the preceding vehicle occurs, using the speed of the front vehicle obtained based on information of variations in the detected distance from the vehicle 100 to the preceding vehicle and the acquired image of the front vehicle.

Specifically, the controller 150 may be configured to monitor variations in the distance from the vehicle 100 to the preceding vehicle detected in real time to generate the information of variations in the distance from the subject vehicle 100 to the preceding vehicle, and detect the speed of the preceding vehicle and/or variations in the speed of the preceding vehicle using the information of variations in the distance. The controller 150 may further be configured to detect the failure of the rear brake lamp of the preceding vehicle, using the detected speed of the preceding vehicle and the acquired image of the preceding vehicle. For example, the controller 150 may be configured to detect the failure of the rear brake lamp of the preceding vehicle when the speed of the preceding vehicle is reduced and the rear brake lamp of the preceding vehicle detected from the acquired image is not turned on.

In addition, the controller 150 may be configured to detect the failure of the rear brake lamp of the preceding vehicle, in consideration of the friction coefficient of the road on which the vehicle is traveling. For example, when a reduction in the speed of the preceding vehicle is greater than a reduction in the speed by the friction coefficient of the road and the rear brake lamp of the preceding vehicle is not turned on, the controller 150 may be configured to detect the failure of the rear brake lamp of the preceding vehicle. In other words, the reduction in the speed of the preceding vehicle may be caused by the friction coefficient of the road, which needs to be considered. Therefore, the controller 150 may be configured to more accurately detect the failure of the rear brake lamp of the front vehicle.

Furthermore, the controller 150 may be configured to generate the acceleration and deceleration state information regarding the preceding vehicle when the failure of the rear brake lamp of the front vehicle is detected. In addition, the controller 150 may be configured to generate the acceleration and deceleration state information when the state of the driver is determined as a careless driving state. For example, when the careless driving state of the driver such as negligence in looking ahead or drowsy driving is detected by the driver state detection unit 140, the controller 150 may be configured to generate the acceleration and deceleration state information. Meanwhile, in response to determining, based on the generated acceleration and deceleration state information, that the speed of the preceding vehicle is reduced and a reduction in the speed of the preceding vehicle is greater than or equal to a predetermined value, the controller 150 may be configured to turn on emergency lights of the vehicle 100 to prevent a secondary collision with a rear vehicle or may be configured to operate a braking system (not shown) to cause the vehicle to automatically decelerate.

The acceleration and deceleration state information will be described with reference to FIGS. 2A and 2B. Referring to FIGS. 2A and 2B, the acceleration and deceleration state information may be indicated by visualizing the amount of acceleration or deceleration of the preceding vehicle. For example, the acceleration and deceleration state information may be defined by showing different colors according to whether the preceding vehicle is accelerated (a blue color) or decelerated (a red color). Other indications for distinguishing the acceleration and deceleration may also be used. In addition, the acceleration and deceleration state information may be defined to indicate the amount of acceleration or deceleration. For example, when the front vehicle is decelerated, as the number of highlighted spaces (e.g., red or blue color slots) increases, it may be understood that the amount of deceleration is high (e.g., an increased amount of pressure is exerted onto the pedal).

Referring to FIG. 1, the output unit 160 may be configured to output the acceleration and deceleration state information. The output unit 160 may be a speaker, a haptic sensor, a display panel, a head up display (HUD), or the like. For example, when the output unit 160 is a speaker, the output unit 160 may be configured to output the acceleration or deceleration state of the front vehicle in the form of a warning alarm or a voice message. When the output unit 160 is a haptic sensor, the output unit 160 may be disposed inside the steering wheel or a seat and may be configured to output the acceleration or deceleration state of the preceding vehicle in the form of vibrations. When the output unit 160 is a display panel, the output unit 160 may be configured to output the acceleration or deceleration state of the preceding vehicle in the form of an image as illustrated in FIG. 2A or 2B. The output unit 160 provided as a HUD will be described with reference to FIGS. 3 and 4.

Referring to FIG. 3, when the output unit 160 is a HUD, the output unit 160 may be configured to output the acceleration or deceleration state of the preceding vehicle on the windshield of the vehicle 100. In addition, referring to FIG. 4, when the output unit 160 is a large HUD, the acceleration and deceleration state information of the preceding vehicle may be output in a peripheral area of the front vehicle (i.e., a target vehicle). Referring to FIG. 1, the communication unit 170 may be configured to transmit the acceleration and deceleration state information to surrounding vehicles. Thus, the surrounding vehicles may be configured to recognize the acceleration or deceleration state of the preceding vehicle traveling in front of the subject vehicle 100, thereby inducing safety driving. The communication between the subject vehicle and the surrounding vehicles may be via wireless communication. In addition, the communication unit 170 may also be configured to transmit the failure of the rear brake lamp of the preceding vehicle to the preceding vehicle itself.

Figure 5:
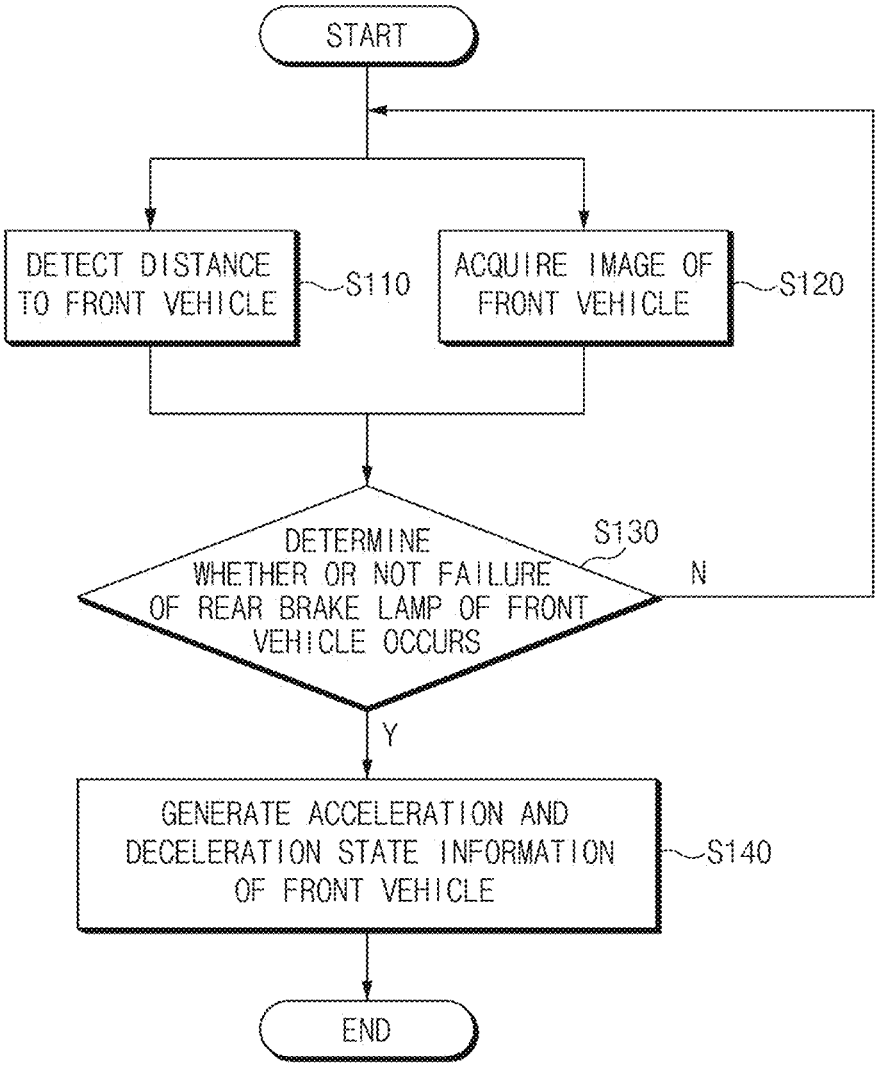
FIG. 5 illustrates a flowchart of a method for supporting driving safety of a vehicle, according to a first exemplary embodiment of the present disclosure.

FIG. 5 illustrates a flowchart of a method for supporting driving safety of a vehicle, according to a first exemplary embodiment of the present disclosure. The method described herein below may be executed by the controller. Referring to FIG. 5, the method for supporting driving safety of a vehicle, according to the first exemplary embodiment of the present disclosure, may include: detecting a distance from the vehicle (e.g., subject or traveling vehicle) to a preceding vehicle in operation S110; acquiring an image of the front vehicle in operation S120; detecting a failure of a rear brake lamp of the preceding vehicle in operation S130; and generating acceleration and deceleration state information of the preceding vehicle in operation S140. As a result of operation S130, when the failure of the rear brake lamp of the front vehicle is detected, operation S140 may be performed. Operations S110 and S120 may be performed simultaneously or sequentially.

Hereinafter, operations S110 to S140 will be described in more detail with reference to FIG. 1. In operation S110, the distance detection unit 110 may be configured to detect the distance from the vehicle 100 to the preceding vehicle. For example, the distance detection unit 110 may be a radar sensor, a lidar sensor, an ultrasonic sensor, or a laser sensor, but is not limited thereto. The distance detection unit 110 may include various types of sensors configured to measure a distance.

In operation S120, the image acquisition unit 120 may be configured to acquire the image of the preceding vehicle. For example, the image acquisition unit 120 may be a lane departure warning (LDW) camera. The image acquisition unit 120 may be disposed in a direction toward the front of the vehicle 100. The image acquisition unit 120 may be configured to transmit the image of the front vehicle to the controller 150. In operation S130, the controller 150 may be configured to detect the failure of the rear brake lamp of the preceding vehicle occurs using a speed of the preceding vehicle obtained using information of variations in the detected distance from the vehicle 100 to the preceding vehicle and the acquired image of the preceding vehicle.

Specifically, the controller 150 may be configured to monitor variations in the distance from the subject vehicle 100 to the preceding vehicle detected in real time to generate the information of variations in the distance from the vehicle 100 to the preceding vehicle, and detect the speed of the preceding vehicle and/or variations in the speed of the preceding vehicle using the information of variations in the distance. The controller 150 may be configured to detect the failure of the rear brake lamp of the preceding vehicle, using the detected speed of the preceding vehicle and the acquired image of the preceding vehicle. For example, the controller 150 may be configured to detect the failure of the rear brake lamp of the preceding vehicle when the speed of the preceding vehicle is reduced and the rear brake lamp of the preceding vehicle detected from the acquired image is not turned on (e.g., remains off or is not illuminated) In operation S140, the controller 150 may be configured to generate the acceleration and deceleration state information of the front vehicle when the failure of the rear brake lamp of the front vehicle is detected. The acceleration and deceleration state information may be substantially the same as that described above with reference to FIGS. 2A and 2B.

Figure 6:
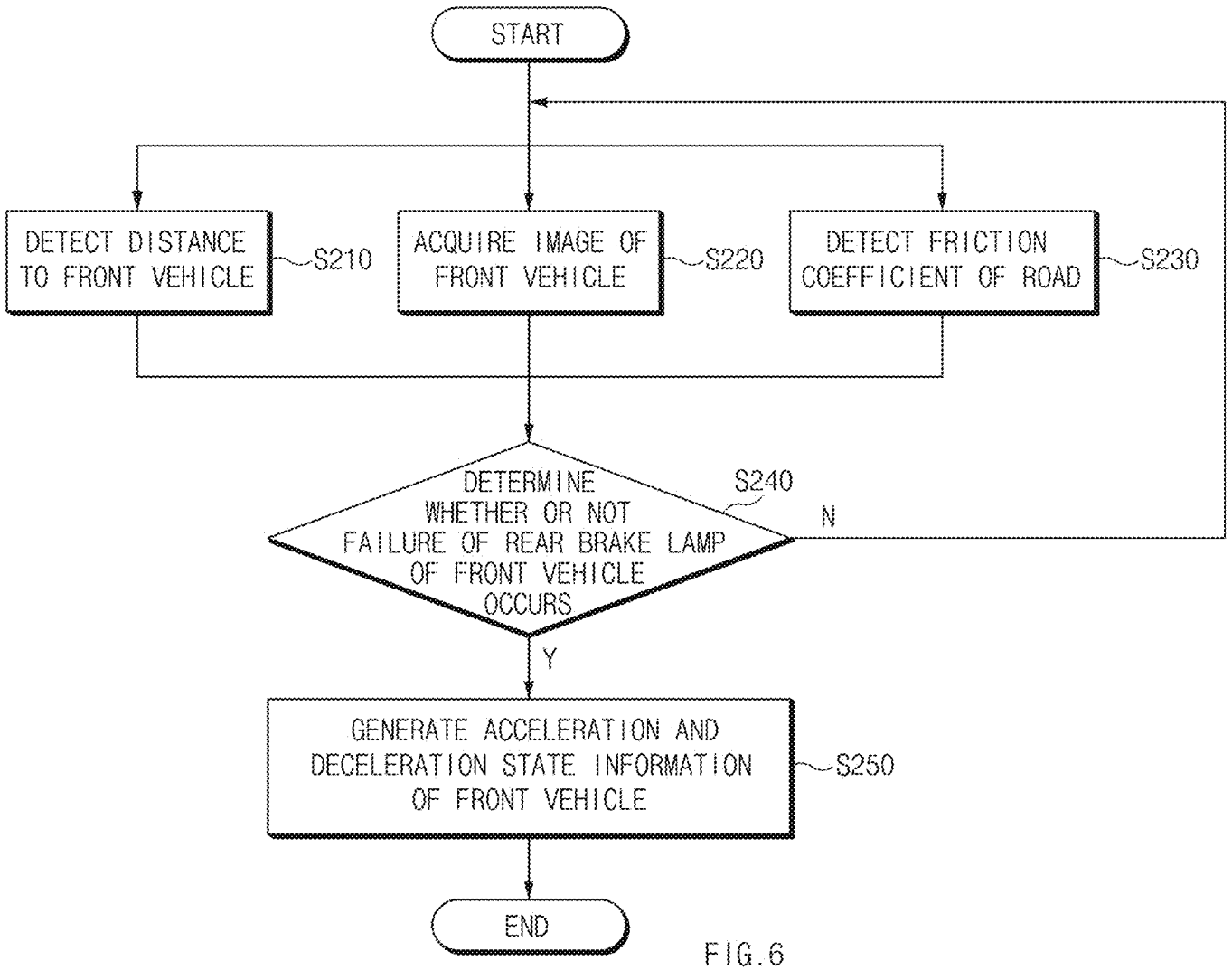
FIG. 6 illustrates a flowchart of a method for supporting driving safety of a vehicle, according to a second exemplary embodiment of the present disclosure.

FIG. 6 illustrates a flowchart of a method for supporting driving safety of a vehicle, according to a second exemplary embodiment of the present disclosure. Referring to FIG. 6, the method for supporting driving safety of a vehicle, according to the second exemplary embodiment of the present disclosure, may include: detecting a distance from the subject vehicle to a preceding vehicle in operation S210; acquiring an image of the preceding vehicle in operation S220; detecting a friction coefficient of a road on which the subject vehicle is traveling in operation S230; detecting a failure of a rear brake lamp of the preceding vehicle in operation S240; and generating acceleration and deceleration state information of the preceding vehicle in operation S250. As a result of operation S240, when the failure of the rear brake lamp of the preceding vehicle is detected, operation S250 may be performed. Operations S210 to S230 may be performed simultaneously or sequentially.

Since operations S210, S220, and S250 are substantially the same as operations S110, S120, and S140 described above with reference to FIG. 5, respectively, operations S230 and S240 will be described below with reference to FIG. 1. In operation S230, the friction detection unit 130 may be configured to detect the friction coefficient of the road on which the vehicle 100 is traveling. For example, the friction detection unit 130 may include a wheel speed sensor, a vehicle speed sensor, a yaw rate sensor, a steering angle sensor, and a lateral acceleration sensor, and may be configured to obtain the friction coefficient of the road using information obtained by the sensors.

In operation S240, the controller 150 may be configured to detect the failure of the rear brake lamp of the preceding vehicle, in consideration of the friction coefficient of the road on which the vehicle is traveling. For example, when a reduction in the speed of the preceding vehicle is greater than a reduction in the speed by the friction coefficient of the road and the rear brake lamp of the preceding vehicle is not turned on, the controller 150 may be configured to detect the failure of the rear brake lamp of the preceding vehicle. In other words, the reduction in the speed of the preceding vehicle may be caused by the friction coefficient of the road, which needs to be considered. Therefore, the controller 150 may be configured to more accurately detect the failure of the rear brake lamp of the preceding vehicle.

Figure 7:
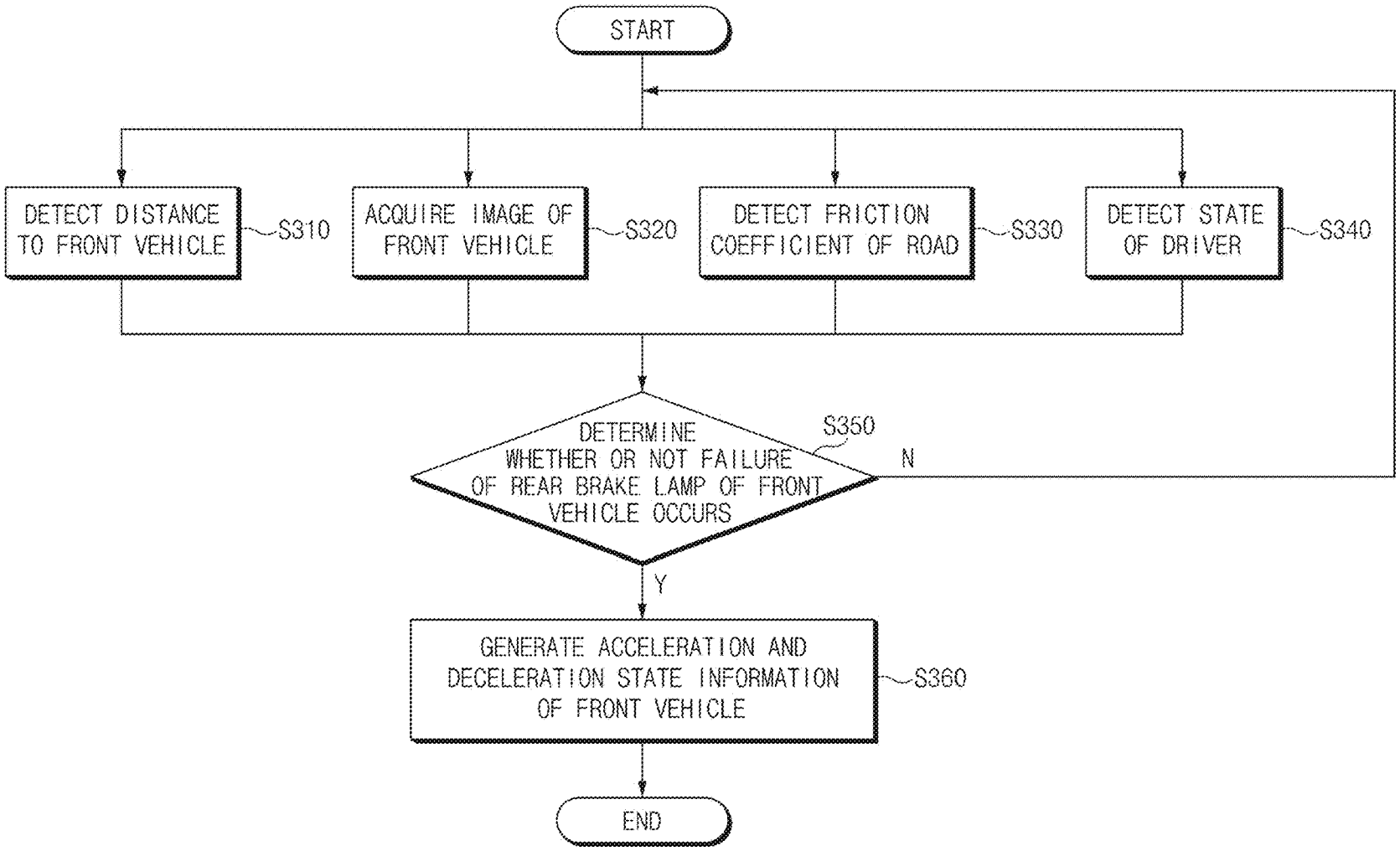
FIG. 7 illustrates a flowchart of a method for supporting driving safety of a vehicle, according to a third exemplary embodiment of the present disclosure.

FIG. 7 illustrates a flowchart of a method for supporting driving safety of a vehicle, according to a third exemplary embodiment of the present disclosure. Referring to FIG. 7, the method for supporting driving safety of a vehicle, according to the third exemplary embodiment of the present disclosure, may include: detecting a distance from the subject vehicle to a preceding vehicle in operation S310; acquiring an image of the preceding vehicle in operation S320; detecting a friction coefficient of a road on which the vehicle is traveling in operation S330; detecting a state of a driver in operation S340; detecting a failure of a rear brake lamp of the preceding vehicle in operation S350; and generating acceleration and deceleration state information of the preceding vehicle in operation S360. As a result of operation S350, when the failure of the rear brake lamp of the preceding vehicle is detected, operation S360 may be performed. Operations S310 to S340 may be performed simultaneously or sequentially.

Since operations S310 to S330 are substantially the same as operations S210 to S230 described above with reference to FIG. 6, respectively, operations S340 to S360 will be described below with reference to FIG. 1. In operation S340, the driver state detection unit 140 may be configured to acquire an image of the driver and detect a state of the driver from the acquired image of the driver. For example, the driver state detection unit 140 may be configured to detect whether the driver is driving carelessly. The driver state detection unit 140 may be configured to detect the careless driving state of the driver when the driver is driving while drowsy by detecting an area of the eyes of the driver from the driver's image, and whether the driver is looking ahead by detecting a direction of the face of the driver from the driver's image. The driver state detection unit 140 may be disposed in a steering wheel of the vehicle 100 to acquire an image of a facial area of the driver.

In operation S350, the controller 150 may be configured to detect the failure of the rear brake lamp of the preceding vehicle, using the speed of the preceding vehicle obtained using information of variations in the detected distance from the vehicle 100 to the preceding vehicle and the acquired image of the preceding vehicle. For example, the controller 150 may be configured to detect the failure of the rear brake lamp of the preceding vehicle when the speed of the preceding vehicle is reduced and the rear brake lamp of the preceding vehicle detected from the acquired image is not turned on.

In addition, the controller 150 may be configured to detect the failure of the rear brake lamp of the preceding vehicle, in consideration of the friction coefficient of the road on which the vehicle is traveling. For example, when a reduction in the speed of the preceding vehicle is greater than a reduction in the speed by the friction coefficient of the road and the rear brake lamp of the preceding vehicle is not turned on, the controller 150 may be configured to detect the failure of the rear brake lamp of the preceding vehicle.

In operation S360, the controller 150 may be configured to generate the acceleration and deceleration state information of the preceding vehicle when the failure of the rear brake lamp of the preceding vehicle is detected. Particularly, the controller 150 may be configured to generate the acceleration and deceleration state information when the state of the driver is determined as a careless driving state. For example, when the careless driving state of the driver such as negligence in looking ahead or drowsy driving is detected by the driver state detection unit 140, the controller 150 may be configured to generate the acceleration and deceleration state information.

As set forth above, the vehicle and the method for supporting driving safety thereof, according to exemplary embodiments, may detect the failure of the rear brake lamp of the preceding vehicle to support the driver's driving safety.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A vehicle, comprising:

a distance detection unit configured to detect a distance from the vehicle to a preceding vehicle;

an image acquisition unit configured to acquire an image of the preceding vehicle;

a controller configured to detect a failure of a rear brake lamp of the preceding vehicle using variations in a speed of the preceding vehicle obtained based on information of variations in the detected distance and the acquired image of the preceding vehicle, and generate acceleration and deceleration state information of the preceding vehicle when the failure of the rear brake lamp of the preceding vehicle is detected, wherein the controller is configured to detect the failure of the rear brake lamp of the preceding vehicle when the speed of the preceding vehicle is reduced and the rear brake lamp of the preceding vehicle detected from the acquired image is turned off; and a friction detection unit configured to detect a friction coefficient of a road on which the vehicle is traveling, wherein the controller is configured to detect the failure of the rear brake lamp of the preceding vehicle when a reduction in the speed of the preceding vehicle is greater than a reduction in the speed by the friction coefficient of the road.

2. The vehicle according to claim 1, further comprising:

a driver state detection unit configured to acquire an image of a driver and detect a state of the driver, wherein the controller is configured to generate the acceleration and deceleration state information when the state of the driver is determined as a careless driving state.

3. The vehicle according to claim 1, further comprising an output unit configured to output the acceleration and deceleration state information.

4. The vehicle according to claim 3, wherein the output unit is a head up display (HUD), and the acceleration and deceleration state information is indicated by visualizing an amount of acceleration or deceleration of the preceding vehicle.

5. The vehicle according to claim 1, further comprising a communication unit configured to transmit the acceleration and deceleration state information of the preceding vehicle to surrounding vehicles.

6. A method for supporting driving safety of a vehicle, comprising:

detecting, by a controller, a distance from the vehicle to a preceding vehicle;

acquiring, by the controller, an image of the preceding vehicle;

detecting, by the controller, a failure of a rear brake lamp of the preceding vehicle, using variations in a speed of the preceding vehicle obtained based on information of variations in the detected distance and the acquired image of the preceding vehicle;

generating, by the controller, acceleration and deceleration state information of the preceding vehicle when the failure of the rear brake lamp of the preceding vehicle is detected, wherein the detection of the failure of the rear brake lamp of the preceding vehicle includes detecting, by the controller, the failure of the rear brake lamp of the preceding vehicle when the speed of the preceding vehicle is reduced and the rear brake lamp of the preceding vehicle detected from the acquired image is turned off; and detecting, by the controller, a friction coefficient of a mad on which the vehicle is traveling, wherein the detection of the failure of the rear brake lamp of the preceding vehicle occurs includes detecting, by the controller, the failure of the rear brake lamp of the preceding vehicle when a reduction in the speed of the preceding vehicle is greater than a reduction in the speed by the friction coefficient of the road.

7. The method according to claim 6, further comprising:

acquiring, by the controller, an image of a driver and detecting a state of the driver, wherein the generation of the acceleration and deceleration state information includes generating, by the controller, the acceleration and deceleration state information when the state of the driver is determined as a careless driving state.

* * * * *